53-243

10/15/85 XP 4,546,594

United States Patent [19]

Mohaupt

[11] Patent Number: 4,546,594

[45] Date of Patent: Oct. 15, 1985

[54] MACHINE AND METHOD FOR LOADING CARTONS WITH IRREGULARLY SHAPED INDIVIDUAL ARTICLES

[75] Inventor: John M. Mohaupt, Blaine, Minn.

[73] Assignee: Delkor Industries, Inc., Minneapolis, Minn.

[21] Appl. No.: 565,357

[22] Filed: Dec. 27, 1983

[51] Int. Cl.[4] ..... B65B 35/50; B65B 35/56; B65B 5/06

[52] U.S. Cl. ..... 53/447; 53/473; 53/539; 53/243

[58] Field of Search ..... 53/447, 54, 152, 153, 53/537, 539, 542, 242, 243

[56] References Cited

U.S. PATENT DOCUMENTS

| | | | |
|---|---|---|---|
| 1,243,406 | 10/1917 | Hawthorne | 53/243 X |
| 2,879,638 | 3/1959 | Hill | 53/243 X |
| 3,041,805 | 7/1962 | Fulco | 53/243 X |
| 3,589,094 | 6/1971 | Pearson | 53/243 X |
| 3,657,860 | 4/1972 | Franklin | 53/537 X |
| 3,822,528 | 7/1974 | Carlsson et al. | 53/542 |
| 3,902,587 | 9/1975 | Checcucci | 53/537 X |
| 3,954,165 | 5/1976 | Snyder | 53/152 X |
| 4,344,523 | 8/1982 | May et al. | 53/537 X |

*Primary Examiner*—Horace M. Culver

*Attorney, Agent, or Firm*—Kinney & Lange

[57] ABSTRACT

A machine and method for loading irregularly shaped articles into cartons. The packages are collected from an input conveyor into partial carton loads which are combined into a complete carton load which is moved into an inverted opened carton which is then turned over and moved to further machinery for flap closing and sealing.

11 Claims, 6 Drawing Figures

MACHINE AND METHOD FOR LOADING CARTONS WITH IRREGULARLY SHAPED INDIVIDUAL ARTICLES

BACKGROUND OF THE INVENTION

This invention relates to a machine for inserting a plurality of irregular packaged or unpackaged items into a carton. More particularly, the invention provides a method and apparatus for inserting a full carton load of packages containing one or more objects into an opened carton.

Packaged articles having irregular shape which are packed in cellophane, wax paper or similar substances are extremely difficult to automatically pack into cartons. Automatic carton filling machines work particularly well with individually packed small boxes of products which can be handled with suction cup lifting devices and other well-known item handling apparatus which have utility in packing machines. Such apparatus which relies upon the regular and repeatable shape and configuration of the individual packages is not workable with flexible packages with irregularly shaped packages, such as cookies packaged either individually or in small quantities in cellophane bags. Irregular products of this nature are impossible to align on a conveyor in a back-to-back or edge-to-edge configuration because of their tendency to override each other or bunch up. Those sorts of packages cannot be handled well using vacuum cup lifters or any similar apparatus, and the flexibility and fragility of the packages and their contents do not lend themselves to prior art loading apparatus and techniques.

The apparatus of the present invention utilizes a consolidation approach to form a series of partial carton loads of individual packages, each of which may contain one or more articles. A complete carton load, comprised of a number of partial carton loads, may then, if desired, be inverted for insertion into an opened and inverted carton, and the combined carton and load of individual packages may then be inverted and placed on a conveyor for transport to further carton closing, sealing and handling means of a conventional nature.

SUMMARY OF THE INVENTION

In view of the lack of machines in the prior art for handling small, irregularly shaped flexible packages having fragile contents, such as cellophane-wrapped cookies and bagged peanuts, for example, it is the primary object of the present invention to provide a method and a machine for carrying out a method of collating a plurality of packages, arranging them in partial carton loads in the form in which they are to be inserted into an opened carton and then inserting the complete carton load of individually wrapped articles into an inverted carton to avoid lifting individual packages and dropping them into a carton.

The apparatus of the invention comprises a conveyor means for serially transporting individual packages to a collection point and collating means located at the collection point for receiving packages from the conveyor and including at least one chamber constructed and arranged for receiving a partial carton load of a predetermined number of packages from the conveyor means and then indexing the chamber and partial carton load to an intermediate accumulating location. The apparatus also includes means for collectng at least a predetermined number partial carton loads from multiple chambers of the collating means to form a complete carton load of packages arranged at a staging area of the inverting means. The apparatus also includes pusher means for moving a complete carton load of packages from the staging area of the inverting means onto a loading platform and carton feed means for positioning an inverted opened carton above the carton load of packages positioned on the loading platform. The machine utilizes actuator means for moving the complete carton load of packages on the loading platform into the opened carton, while restraining the packages from falling from the carton and also including pivotal means constructed and arranged for inverting the loaded carton and its contents and depositing them in an output location.

Important features of the present invention have been outlined rather broadly above in order that the detailed description thereof that follows may be better understood and in order that the present contribution to the art may be better appreciated. There are, additional features of the invention that will be described hereinafter and which will form the subject of the claims appended hereto. Those skilled in the art will appreciate that the conception, upon which this disclosure is based, may be readily utilized as a basis for designing of other structures for carrying out the several purposes of the present invention. It is important, therefore, that the claims be regarded as including such equivalent construction so far as they do not depart from the spirit and scope of the present invention.

BRIEF DESCRIPTION OF ACCOMPANYING DRAWINGS

Specific embodiments of the present invention have been chosen for the purpose of illustration and description and are shown in the accompanying drawings forming a part of the specification, in which.

DESCRIPTION OF THE PREFERRED EMBODIMENT

Figure 1:
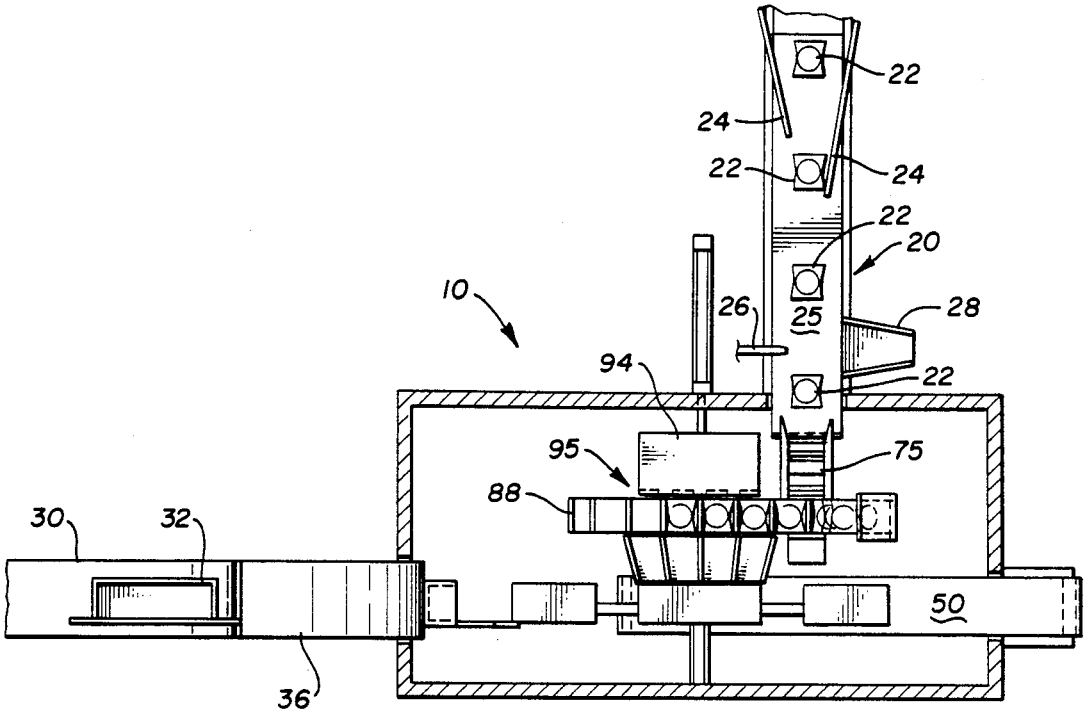
FIG. 1 is a plan view of the apparatus of the invention showing a top plan view of the general arrangement relative to a box input conveyor and a package delivery conveyor and a loaded carton delivery conveyor system.

Referring to FIG. 1, the general arrangement of the overall machine is shown schematically, including the unique collating apparatus 10 of the invention. The overall arrangement includes an incoming serial package conveyor 20 carrying packages or objects 22 which may include one or more objects, such as cookies, peanuts or the like enclosed in cellophane, glassine, waxed paper or similar packaging material. The invention will also, of course, operate with packages which are individually boxed, but those particular types of packages can be handled by prior art types of machinery, while the aforementioned irregular packages are not readily handled by prior art machinery.

Serial conveyor means 20 includes package guides 24 arranged to orient individual packages along the center line of conveyor belt 25 which moves in the direction shown by the arrow in FIG. 1. Belt 25 of conveyor 20 operates at a generally constant speed, but the spacing of the individual packages 22 on belt 25 may vary considerably, depending upon the operating speed and consistency of the packaging machine which prepares the individual packages 22. In order to assure optimal operation of the apparatus of this invention, it is only necessary that the individual packages be delivered with some slight, but not necessarily constant, spacing between them.

Various optical checks may be made on the packages as they move along conveyor 20, and "reject" packages can be forced ejected from the conveyor before reaching the collating apparatus by an ejection mechanism 26 which propels "reject" packages from conveyor means 20 into a reject slide 28 which, in turn, conveys them to any suitable bin or collection apparatus for further handling.

In addition to the package conveyor means 20, FIG. 1 also shows a carton feed means or conveyor 30 which delivers individual opened cartons 32. Cartons 32 can be set up by carton forming machinery which is well known in the prior art or cartons can be loaded onto conveyor 30 by manual means having previously been assembled and opened either manually or by well-known machinery. An opened carton 32 is shown on conveyor 30, and its top flaps 34 can be clearly seen in FIG. 2. Carton 32 is delivered to the interior of apparatus 10 by a guide or chute 36 shown in schematic form in FIGS. 1 and 2. Cartons 32 are dropped with their opened top portion 34 facing the interior of the machine, coming to rest on a support plate 38 until the carton is engaged by a loading head 40 which is mounted on one of the four arms 42 of a loading turret 44.

Figure 2:
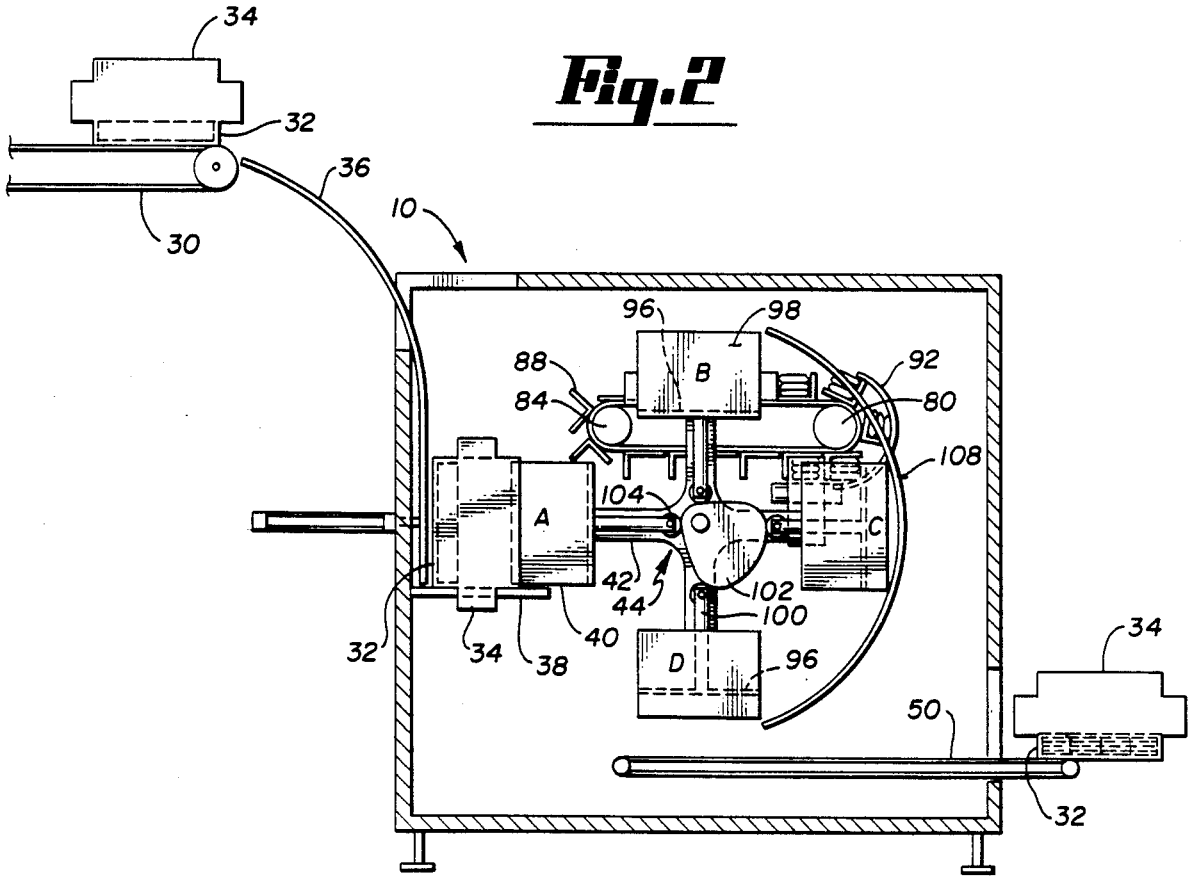
FIG. 2 is a sectional elevational view of the apparatus shown in FIG. 1, taken along line 2—2 in FIG. 1.

FIGS. 1 and 2 also show output conveyor means 50 which receive carton 32 and a complete carton load when positioned beneath turret 44 and transport it to the right, as viewed from the FIG. 1, out of machine 10 and deliver it to further machines or manual work stations for closing and sealing operations which can be performed by conventional machinery.

Figure 3:
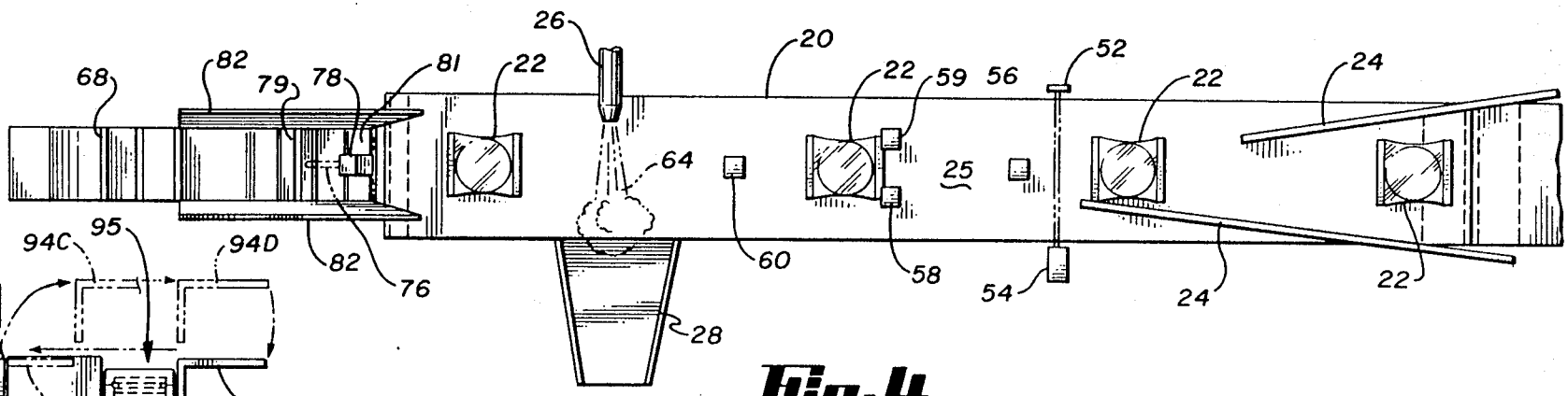
FIG. 3 is a more detailed view of the package conveying means of FIG. 1 shown in plan view.
Figure 4:
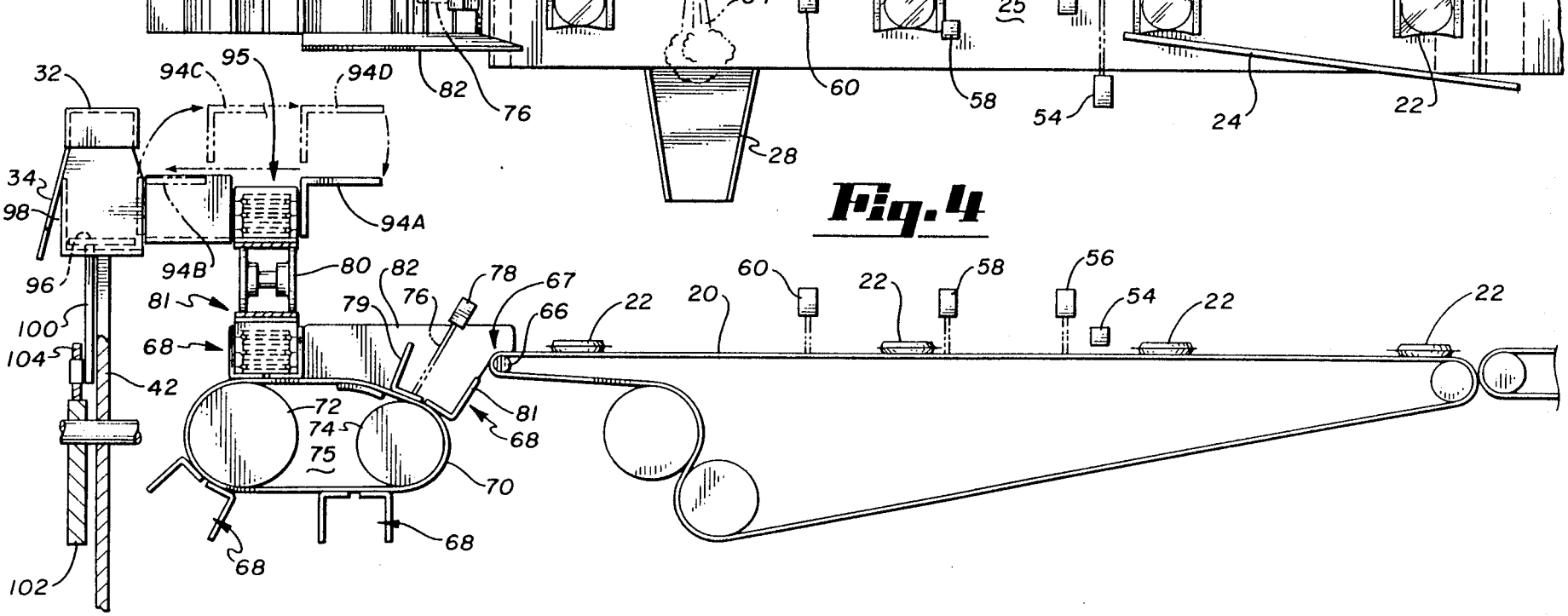
FIG. 4 is an elevational view of the serial conveyor of FIG. 1 and the collating means.

FIGS. 3 and 4 show, in further detail, package conveyor 20 and the collating and collection portions of the apparatus. Conveyor 20 is shown with a plurality of packages 22 arrayed on belt 25. Belt 25 is moving from right to left, as viewed in the Figures, at a generally constant rate of speed, and packages 22 have been aligned at the center line of belt 25 by guides 24.

The height or vertical elevation of package 22 on belt 25 is checked by an optical source 52 and sensor 54 which are positioned to pass a beam over belt 25 at a height just exceeding the thickness of the thickest expected package to make certain that the package is lying flat on the belt and that two packages are not stacked on top of each other.

Further sensors 56, 58, 59 and 60 can be utilized to check other characteristics of the package, such as its alignment on the belt, for example. The alignment is determined by the outputs of sensors 58 and 59. Well-known measurement circuitry can be ued to take the information from sensors 54, 56, 58, 59 and 60 and correlate it with the continuing movement of conveyor 20. Sensors 56 and 60 provide outputs which can be used to determine the rate of delivery of objects 22 to the collating means 81. This is necessary to avoid arrival of adjacent products during the index interval of the collating means. If this is done, out of tolerance or irregular packages 22 can be ejected from conveyor 20 by the "blow-by" unit 62 shown in schematic form at the side of conveyor 20. That unit can eject an out of tolerance product from conveyor 20 using a blast of air shown pictorially with reference character 64 to force undesired packages into the ejection chute 28.

The majority of the packages 22 reach a collection point 67 at the end of conveyor 20 where belt 25 passes over pulley 66 and allows package 22 to drop into a chamber 68 affixed to a belt or chain 70 passing over a pair of pulleys or sprockets 72 and 74. Belt 25 and plurality of chambers 68 and the pulleys 72 and 74 together comprise a collating means or apparatus 75. Each package 22 which leaves the end of conveyor 20 to drop into chamber 68 breaks an optical beam shown schematically in FIG. 4 and marked with reference character 76 to provide an indication from an optical detector 78 indicating the addition of an additional package 22 to chamber 68.

When detector 78 indicates that the desired predetermined number of packages 22, corresponding to a partial carton load, has been placed in a particular chamber 68, a command signal is delivered by conventional control electronic circuitry, not specifically shown herein, to advance one of pulleys 72 or 74 to drive the belt 70 to position loaded chamber 68 at the next sequential location. The location is anticlockwise of the position at the collection point 67 in FIG. 4 and is directly beneath the drive hub 80 of the collecting and inverting structure which will be described later. This position is also referred to as the intermediate accumulating location 81. Thus, collating means 75 operates intermittently in response to the receipt of a partial carton load of a predetermined number of packages 22 in a particular chamber 68.

In a typical arrangement, three packages of cookies, snack cakes or the like may form a partial carton load and are transported to intermediate accumulating location 81 beneath hub 80 for further handling, while an empty chamber 68 is positioned at the end of conveyor 20 to receive the next three packages to form a further partial carton load.

The transfer of the individual packages 22 from conveyor 20 to chambers 68 of collating means 75 does not require the use of vacuum actuated picking means or any direct manipulation of the packages. They merely fall from the end of conveyor 20 at collection point 67 into chamber 68 and are further transported to intermediate accumulating location 81 after a partial carton load of a predetermined number of packages arrive. Because collating mechanism 75 does not move chamber 68 until the predetermined number of packages has actually arrived, removal of reject packages from conveyor 20 or grossly divergent spaces between adjacent packages 22 has no deleterious effect on the assembly of the load of packages to be inserted in the carton. The operation of the apparatus is asynchronous.

Figure 5:
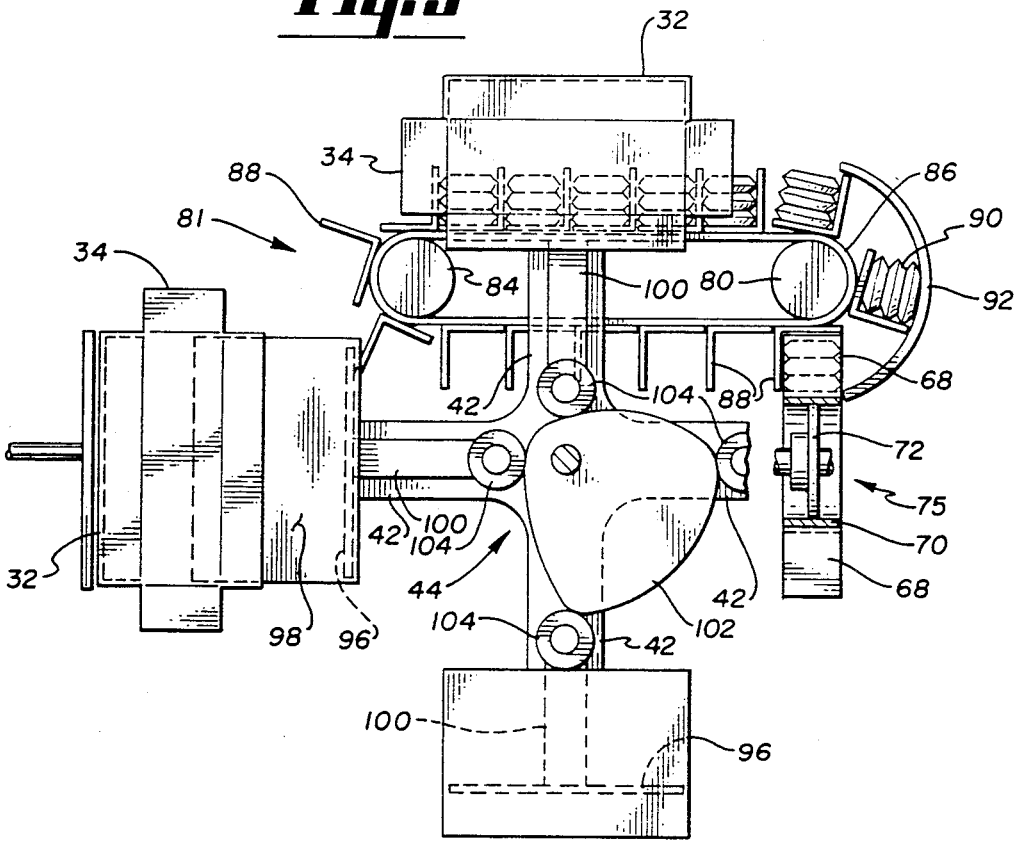
FIGS. 5 and 6 are views showing the carton handling turret, the package inverting and collecting means and the collating means with FIG. 5 being partially cut away to show the interaction of the collating and collecting and inverting means.
Figure 6:
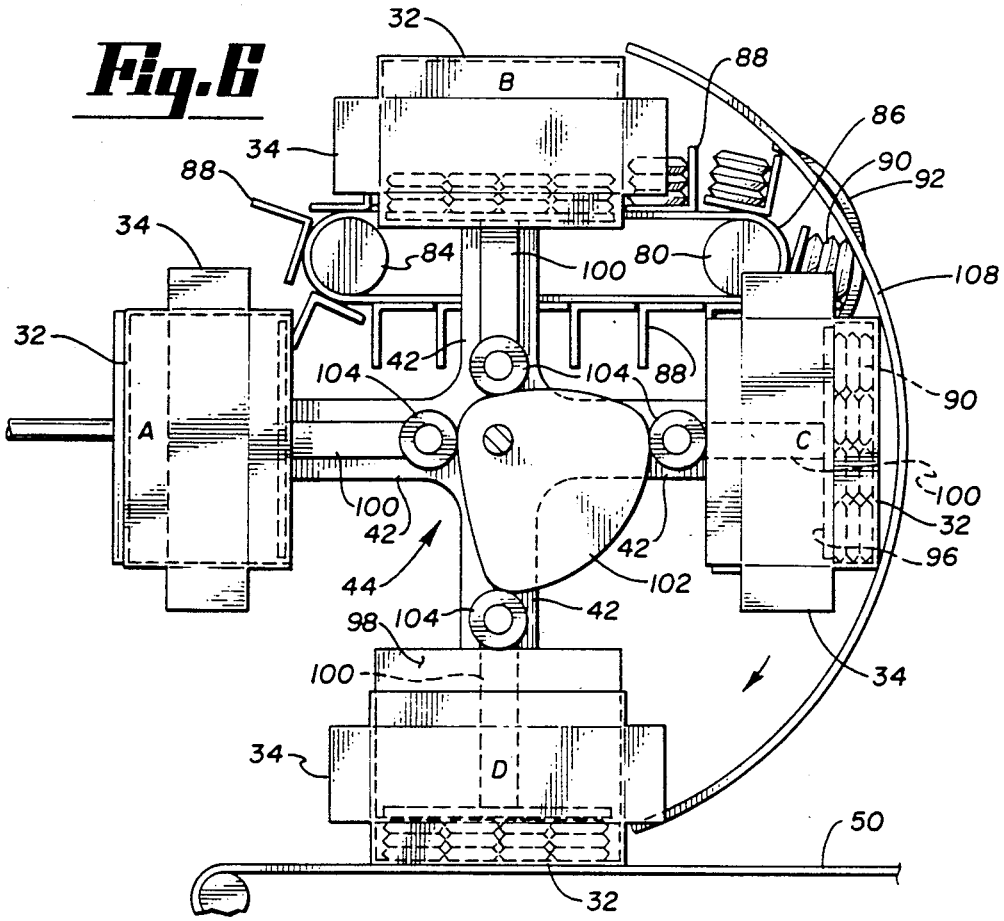

The details of the collecting and inverting means are shown most clearly in FIGS. 5 and 6. The collating means 75 is shown in FIG. 5 where one of the arms 42 has been cut away. As can also be seen in FIG. 4, each of the chambers 68 of collating means 75 has a leading wall 79 and a trailing wall 83, but no side wall. In order to keep packages 22 from falling out of chambers 68 as collating means 75 is advanced, there may be guide walls 82 placed on both sides of the collating means, as shown, for example, in FIG. 3. Guide walls 82 are also shown in FIG. 4, but they do not extend into the intermediate accumulating location 81 below hub 80 where collating means 75 interfaces with the collecting and inverting means 87.

FIG. 5 shows the collecting and inverting means 87 which is driven by hub or pulley 80 and a further hub or pulley 84. A belt 86 passes over both hubs, one of which is driven by conventional rotating means, such as a servomotor, in response to commands from appropriate control circuitry for incrementally advancing the collecting means in a step-by-step manner in synchronism with the operation of collating means 75.

Collecting mechanism 87 includes a plurality of "L"-shaped scooping elements 88, each of which sweeps a partial carton load of packages 22 out of chamber 68 of collating means 75 through the open side of collating means 87.

In FIG. 5, one scooping means 88 is shown engaging a partial carton load of packages resting in chamber 68 of collating means 75, while a second partial carton load labelled 90 can be seen displaced slightly from collating means 75 and enclosed in the guide structure 92 which maintains the partial package load in scooping element 88 as it is incrementally advanced and inverted from the position in which it engaged the partial carton load of packages 22 in collating means 75. Several partial carton loads of packages are shown on the top surface of the collecting means in FIG. 5.

When viewed as shown in FIG. 4, the collecting and inverting structure 81 can be seen to engage a partial carton load of packages 22 carried by chambers 68 of collating means 75 and to move them upwardly into the position shown in FIG. 4. After a desired number of partial carton loads are aligned side-by-side, as shown in FIGS. 5 and 6 at the top of collecting means 87, a pusher 94 pushes several partial carton loads which together comprise a complete carton load from a staging area 95 in collecting assembly 87 and moving them to the left, as shown in FIG. 4, to a loading platform 96 positioned beneath an inverted opened carton 32.

As shown in schematic form in FIG. 4 with the aid of broken line drawings, the operation of pusher 94 comprises four separate motions. Pusher 94 starts from an initial position indicated by reference character 94A and moves to a second position 94B during the dwell time while partial load in chamber 68 is being collected. This dwell time must be less then the time required to collect a partial carton load of objects 22. As shown in broken outline, pusher 94 moves the carton load of packages from staging area 95 to loading platform 96 beneath inverted opened carton 32. In the next sequential step, pusher 94 is moved to the right and upwardly to clear the structure of collecting and inverting means 87 to a position 94C and then is moved to a position 94D retracted fully to the right without interferring with collecting means 87 to position 94D and is then returned to the original position 94A. This is done to allow collating to continue while loading of carton is taking place. The four motions of pusher 94 are repeated for each carton cycle and are accomplished as collating means 75 advances through several further steps to assemble a new carton load of individual packages for insertion into the next carton.

In order to facilitate the efficient operation of the system, individually opened cartons 32 are positioned above loading platform 96 in a turret arrangement shown most clearly in FIGS. 5 and 6. Turret 44 has four arms 42, each of which has a carton carrying structure comprised of a backwall 98 and a loading platform 96 which is reciprocally operated by a drive arm which, in the preferred embodiment shown, is moved relative to support arm 42 by the action of a cam 102 and cam followers 104, as shown in FIGS. 4, 5 and 6. Turret 44 rotates through a quarter of a revolution in the time required to advance the collecting structure through a sufficient number of steps to assemble the next complete carton load.

For different sizes of packages, of course, the relative movement of carton carrying turret 44 and the package collecting and inverting means 87 can be modified. The drive circuitry for controlling the rotation of turret 44 and the operation of collating means 75, collecting means 87 and pusher 94 are conventional and not explicitly shown.

In FIG. 6, the progression of cartons 32 is shown from the initial position A, where carton 32 is positioned at the end of the turret arm 42, to the position marked B, where it is positioned above the complete carton load of packages 22, to position C, where inverted carton 32 and individual packages 22 have been moved closely together by the action of cam 102 against cam follower 104 to move the loading platform 96 against the complete carton load of packages to force them fully into the opened carton. Carton 32 is kept from falling from the end of the turret arm 42 by the guide structure 108. Carton 32 and packages 22 then progress to position D where the carton and the packages loaded within it are transferred to conveyor 50, as shown in FIG. 6. The carton and its contents are then driven from the machine and transported to flap closing and sealing apparatus.

What is claimed is:

1. Apparatus for assembling a carton load of individual irregularly shaped products and loading them into an opened carton, comprising, in combination:

a. input conveyor means for transporting individual packages at a random flow rate to a collection point;

b. collating means located adjacent the end of the conveyor means at the collection point for receiving individual packages from the conveyor means, the collating means including at least one chamber constructed and arranged for receiving a partial carton load of a predetermined number of packages from the conveyor means, the collating means also including means for indexing the chamber and its partial carton load to an intermediate accumulating location;

c. collecting means operatively coupled to the collating means for receiving plural partial carton loads from the chambers of the second means at the intermediate accumulating location and for assembling a predetermined number of partial carton loads from successive chambers of the collating means at a staging area of the collecting means thereby to form a completed carton load of packages;

d. pusher means for moving the complete carton load of packages from the staging area of the collecting means onto a loading platform positioned adjacent thereto;

e. carton feed means for positioning an inverted opened carton above the loading platform;

f. actuator means coupled to the loading platform for moving the carton load of packages into the opened carton; and g. pivotal means constructed and arranged for inverting the loaded carton and its contents and depositing them in an output location.

2. The apparatus of claim 1 wherein the conveyor means is a belt conveyor and also includes:

guide means for positioning packages along the centerline of the belt conveyor; and detector means mounted above the centerline of the belt conveyor means for providing an output indication when packages moving along the belt conveyor do not conform to predetermined specifications.

3. The apparatus of claim 2 wherein the detector means also includes at least one sensor for measuring the height of packages on the belt conveyor and providing an output indication for packages having a vertical elevation above the conveyor which exceeds a predetermined value corresponding to the height of a single normal package.

4. The apparatus of claim 3 wherein the detector means is connected to control means for ejecting those packages from the conveyor means which have a vertical elevation or height which exceeds the maximum allowable for a single package.

5. The apparatus of claim 2 wherein the detector means also includes at least one sensor for detecting an object misaligned so as to cause improper operation of the collating means.

6. The invention of claim 2 wherein the detector means also includes at least two sensors constructed and arranged to determine the spacing between adjacent packages and eject packages which are too closely spaced to allow sufficient time for operation of the collating means.

7. The aparatus of claim 1 wherein the collating means comprises:

a continuous conveyor;

at least one chamber mounted on the conveyor for receiving packages from the input conveyor means, each of said chambers including front and rear wall portions and open side portions; and guide means positioned on both sides of the conveyor for providing walls for retaining packages in the chamber as it is moved from the collection point to a point immediately preceding the intermediate accumulating location, the guide means constructed and arranged for permitting removal of packages in each chamber when positioned in the intermediate accumulating position.

8. The apparatus of claim 7 wherein the collecting means includes:

conveying means oriented perpendicular to the conveyor of the collating means and located intersecting the path of the conveyor of the collating means at the intermediate accumulating location, the conveying means including at least one flanged element for scooping packages from a chamber of the collating means and pausing to await movement of the conveyor for positioning a second chamber of the collating means in the intermediate accumulating location for engagement by the next flanged element; and guide means for maintaining packages on the flanged element between the intermediate accumulating location and the staging area.

9. The apparatus of claim 8 wherein the pusher means is constructed and arranged for pushing a carton load of packages from the staging area of the collecting means onto the loading platform without interferring with operation of the collecting means.

10. Apparatus for collating a carton load of individual packages and depositing them into a carton, comprising, in combination:

a. conveyor means for transporting individual packages to a collection point;

b. collating means located at the collection point for receiving packages from the conveyor means, the collating means including at least one chamber constructed and arranged for receiving a partial carton load of a predetermined number of packages from the conveyor means, the collating means also including means for indexing the chamber and the partial carton load to an intermediate accumulating location;

c. collecting and inverting means operatively coupled to the collating means for receiving at the intermediate accumulating location partial carton loads from one of the chambers of the collating means and inverting each of the partial carton loads while maintaining them in an organized arrangement, said inverting means constructed and arranged for collecting at least a predetermined number of partial carton loads from multiple chambers of the collating means to form a complete carton load of packages arranged at a staging area of the inverting means;

d. pusher means for moving a complete carton load of packages from the staging area of the inverting means onto a loading platform positioned adjacent thereto;

e. carton feed means for positioning an inverted opened carton above the carton load of packages positioned on the loading platform;

f. actuator means constructed and arranged for moving the carton load of packages into the opened carton and restraining them from falling from the carton; and g. pivotal means constructed and arranged for inverting the loaded carton and its contents and depositing them in an output location.

11. A method for loading individual articles into a carton comprising the steps of:

a. receiving a plurality of individual articles from an input conveyor;

b. collating the articles into individual charges, each having a predetermined number of articles;

c. assembling several charges into a load;

d. inverting the load;

e. positioning an inverted carton over the load;

f. moving the load and the carton relative to each other to fully insert the load into the carton; and g. inverting the loaded carton and load while supporting the load to maintain its position in the carton.

* * * * *